United States Patent [19]

Wiggs et al.

[11] Patent Number: 4,575,348

[45] Date of Patent: Mar. 11, 1986

[54] OPENING CASE TOY OR AMUSEMENT DEVICE

[76] Inventors: Christopher C. Wiggs, 64 Goldborough Crescent, Chingford, London, England, E4; Christopher J. C. Taylor, 117 Latchmere Rd., London, England, SW11

[21] Appl. No.: 594,534

[22] Filed: Mar. 29, 1984

[30] Foreign Application Priority Data

Mar. 30, 1983 [GB] United Kingdom ..... 8308881

[51] Int. Cl.[4] ..... A63H 13/16

[52] U.S. Cl. ..... 446/310; 446/330; 446/487

[58] Field of Search ..... 446/9, 308, 309, 310, 446/311, 312, 314, 330, 487; 132/79 R, 79 F, 82 R, 83

[56] References Cited

U.S. PATENT DOCUMENTS

| | | | |
|---|---|---|---|
| 677,723 | 7/1901 | Walters | 446/310 |
| 1,347,696 | 7/1920 | Grgic | 446/310 |
| 1,820,926 | 9/1931 | Vasticar | 132/82 R |
| 2,460,444 | 2/1949 | Bering | 132/82 R |
| 2,936,067 | 5/1960 | Kaskey | 132/79 F |
| 3,512,298 | 5/1970 | Poynter | 446/9 |
| 3,586,010 | 6/1971 | Landen | 132/83 |
| 4,407,504 | 10/1983 | Popov | 446/310 |

*Primary Examiner*—Robert A. Hafer
*Assistant Examiner*—Daniel Nolan
*Attorney, Agent, or Firm*—John M. Cone

[57] ABSTRACT

An amusement device comprises a case in which is housed a figure. When the case is closed the figure is hidden within the case and covered by a lid. An operating button accessible when the case is closed can be depressed to actuate a mechanism which opens the lid of the case simultaneously causing the figure to rise from its stored position and to turn through a 90° angle to an erect position in which it stands out from the case.

9 Claims, 6 Drawing Figures

OPENING CASE TOY OR AMUSEMENT DEVICE

FIELD OF THE INVENTION

This invention realtes to an opening case toy or amusement device having a pop-up figure within it.

SUMMARY OF THE INVENTION

More specifically the invention provides an opening case toy comprising a case defined by a base and a lid pivoted together and a figure or other object within the case arranged to be rotatable between collapsed and erect states, and means operable as the lid is raised to move the figure to its erect position and to permit the figure to collapse itself as the lid is lowered.

DESCRIPTION OF PREFERRED EMBODIMENTS

The base preferably has a tray movable in translation relative thereto and is operatively connected to the lid so that when the tray is at one end of its travel the lid is closed and the lid opens as the tray moves tpwards the other end of its travel, the figure being rotatably carried in said tray which is biased by resilient means towards said other end of its travel. The figure is preferably carried on a table journalled in said tray for rotation about an axis parallel to said base and moved as the tray advances towards said other end of its travel over a fence that cooperates with a formation on the lower face of the table to rotate the table and erect the figure. The figure may be mounted on a turntable carried by said table for rotation relative thereto, a peg depending from said turntable becoming entrapped between a pair of adjacent walls after the figure has become erect, the figure being rotated as the tray moves past said peg during further travel of the tray towards said other end.

Preferably the lid has actuating fingers projecting beyond the pivot and engaged at their ends with the tray so that the lid rises and falls as the tray advances and retires. All the working parts of the toy except the resilient means may be moulded in polypropylene, ABS or other suitable plastics material.

BRIEF DESCRIPTION OF DRAWINGS

An embodiment of the invention will now be described by way of example only with reference to the accompanying drawings in which.

DETAILED DESCRIPTION OF PREFERRED EMBODIMENTS

Figure 1:
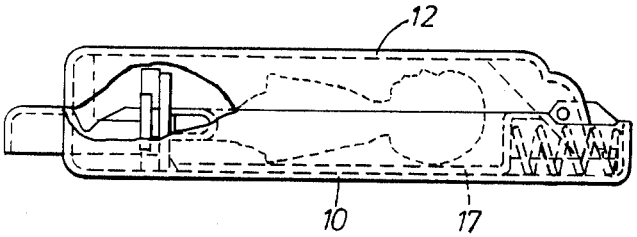
FIG. 1 is a diagrammatic side elevation of an opening case toy according to the invention with the case in the closed position and with the internal parts shown in phantom.
Figure 2:
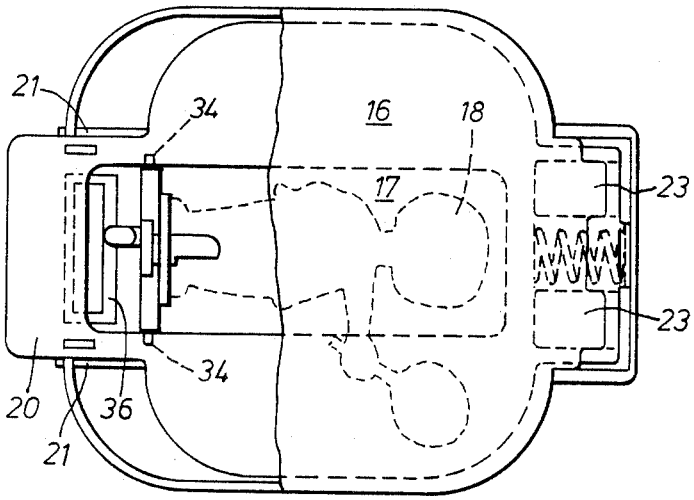
FIG. 2 is a plan view of the toy of FIG. 1 with the case in the closed position.
Figure 3:
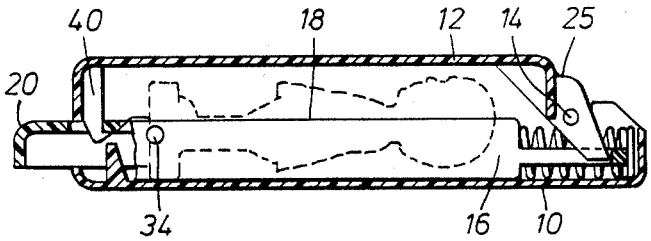
FIG. 3 is a side section of the toy of FIG. 1 with the case in the closed position.

In the drawings an opening case toy has a tray base 10 and a lid 12 pivoted together at 14 to define a case structure within which are provided a sliding tray 16 and a figure 18 rotatably mounted on the tray 16 for movement between erect and collapsed states. The tray base is generally rectangular in plan and is normally held in the hand with the hinged back edge in the fingers and a front projection or "button" portion 20 of the tray 16 projecting through a cut-out portion of the base front wall and engaged with the thumb. The tray 16 conforms to the base interior width but its front to back dimension is less than that of base 10 so that the tray 16 is reciprocable for a limited distance within the base 10. Lateral flanges 21 at the base of the button 20 engaging in slots in the base front wall serve to retain and guide the front of the tray 16. A compression spring 22 acting between the rear walls of the base 10 and tray 16 biases the tray 16 forwardly i.e. towards the position in FIG. 4. The rear edge of the lid 12 is formed with actuating fingers 23 depending below the pivot 14 that are received in socket formations 24 at the rear of the tray 16. In the back position of tray 16 the lid 12 is lowered but as the tray 16 moves forward the fingers 23 rotate the lid 12 upwards until a recessed portion 25 thereof abuts an inturned seat formation 26 in the rear wall of base 10 to define an upright lid position. As the tray 16 is returned to its back position the lid 12 is free to close and if the fingers 23 are close fits into the tray sockets 24 may be urged positively to do so. It is understood that a rectangular tray 16 in a rectangular base 10 is advantageous because the tray is self-guiding but other shapes are possible provided that the tray 16 is properly guided for sliding movement in the base 10.

Figure 4:
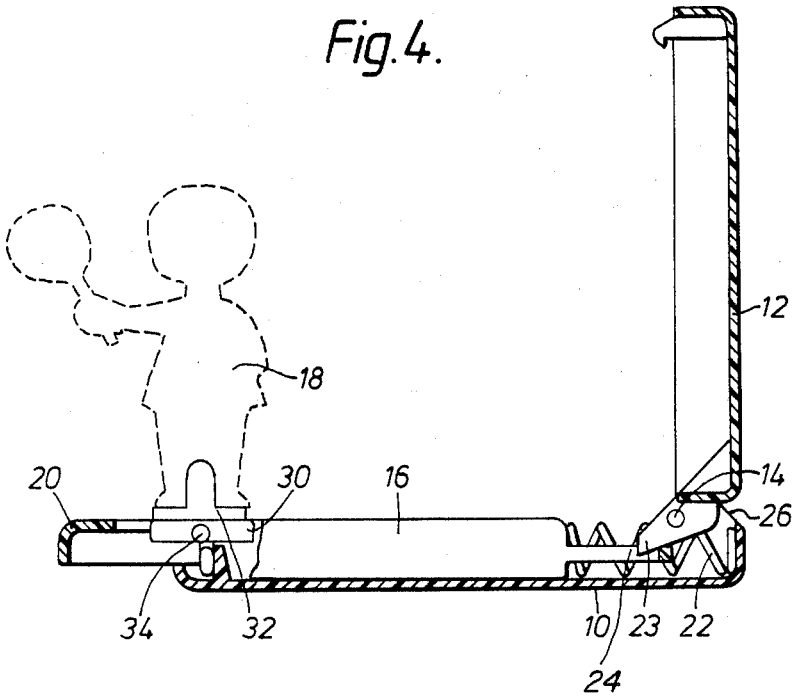
FIG. 4 is a partly sectioned side elevation of the toy of FIG. 1 with the case in the open position.
Figure 5:
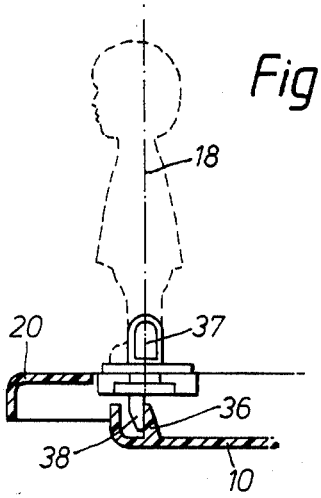
FIGS. 5 and 6 are fragmentary side sections of the toy of FIG. 1 respectively with the lid partly open and fully open showing different rotational positions of a figure within the case.
Figure 6:
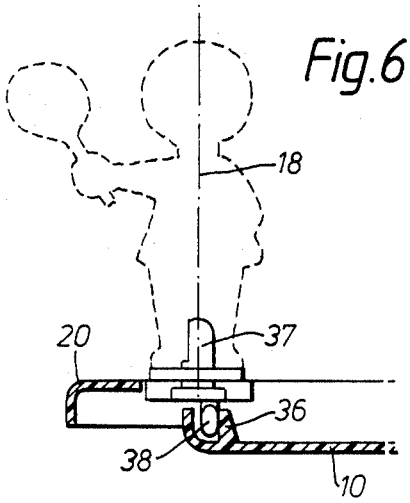

As best seen in FIG. 4 the figure 18 is mounted on a turntable 30 that underlies a table 32 for rotation about an axis normal to that of the table 32 which is itself journalled at 34 in an aperture in the base. The turntable 30 and table 32 are normal to the base 10 when the lid 12 is closed and the tray 16 is at its back position, but as the tray 16 advances the table 32 passes over a fence 36 located behind the front wall of the base 10 and is erected and maintained erect while the tray 16 is at its forward position. An angled wall formation (not shown) depending from the table 32 assists in erecting it. The turntable 30 is formed on its top face with a central upstanding peg 37 that projects through the table 32 and provides a location for the figure 18. On its bottom face it has an eccentrically located depending peg 38 that as the table 32 travels over the fence 36 becomes trapped between the fence 36 and the front wall of the case 10 (FIG. 5). As the tray 16 advances and the lid 12 opens, the table 32 is first moved from its vertical stowed attitude to a horizontal working attitude in which figure 18 is erect, and in the latter potion of its travel the movement past fence 36 causes the entrapped peg 38 to rotate the turntable 30 carrying the figure 18 through an appropriate angle, typically 90°. As the user presses button 20 to collapse the toy the figure 18 and turntable 30 first return to their original positions and then collapse into the tray 16 which is centrally recessed at 17 to receive them, and simultaneously the lid 12 returns to cover the base 10. At the fully collapsed position barbed clamping fingers 40 depending from the front edge of the lid 12 engage in sockets at the front of the tray 16 to hold the lid closed until released by pressure on the button 20 in conventional manner.

It will be appreciated that various modifications may be made to the embodiment described above without departing from the invention, the scope of which is defined in the appended claims.

What is claimed is:

1. An amusement device comprising:

(a) base means and lid means together defining a case;

(b) means pivoting said base means and lid means together;

(c) a display object in said case supported for rotation between collapsed and erect states;

(d) means operable as said lid is raised to move said display object to its erect position and to permit said display object to collapse itself as said lid is lowered;

(e) a tray in said base movable in translation relative thereto and operatively connected to said lid so that when said tray is at one end of its travel said lid is closed and said lid opens as said tray moves towards the other end of its travel;

(f) resilient means biasing said tray towards said other end of its travel;

(g) a table on which said display object is carried, said table being journalled in said tray for rotation about an axis parallel to said base and moved as the tray advances towards said other end of its travel over a fence that cooperates with the lower face of the table to rotate the table and erect the display object.

2. The amusement device of claim 1, wherein said display object is mounted on a turntable carried by said table for rotation relative thereto, a peg depending from said turntable and arranged to become entrapped between a pair of adjacent walls after said display object has become erect, said display object being rotated as said tray moves past said peg during further travel of the tray towards said other end.

3. The amusement device of claim 1, wherein said lid has actuating fingers projecting beyond said pivot and engaged at their ends with said tray so that said lid rises and fallas as said tray advances and retires.

4. The amusement device of claim 1, wherein said lid, base and tray are square in plan.

5. The amusement device of claim 1, wherein said case tray and figure are moulded in a plastics material.

6. An amusement device comprising:

(a) a case;

(b) a display object in said case supported for rotation between collapsed and erect states; and (c) means operable to move said display object to its erect position and to permit said display object to collapse itself (d) a tray in said case movable in translation relative thereto (e) resilient means biasing said tray towards one end of its travel within the case;

(f) a table journalled in said tray for rotation about an axis parallel to said base and moved as the tray advances towards said one end of its travel over a fence that cooperates with the lower face of the table to rotate the table and erect the display object.

7. The amusement device of claim 6, wherein said display object is mounted on a turntable carried by said table for rotation relative thereto, a peg depending from said turntable becoming entrapped between a pair of adjacent walls after said display object has become erect, said display object being rotated as said tray moves past said peg during further travel of the tray towards said one end.

8. An amusement device comprising a case and a display object movable between a collapsed position in which it is housed within the case and an erect position in which it stands proud of said case, wherein said device includes means operable by the user of the device to raise the object from its collapsed position to its erect position and to rotate said object about an axis substantially normal to the case as the object reaches its erect position, said means for raising the object comprising a turntable on which said object is mounted, said turntable being pivotally connected to a tray movable within the case, and fence means cooperating with said turntable during travel of said tray to pivot said turntable about its connection to said tray to raise the turntable and said object to its erect position.

9. An amusement device according to claim 8 wherein said turntable includes means cooperating with said fence means during movement of the tray after the object is erected, to effect said rotation of said object.

* * * * *